United States Patent [19]

Velezis et al.

[11] Patent Number: 5,068,992

[45] Date of Patent: Dec. 3, 1991

[54] FOREARM ASSEMBLY

[76] Inventors: George A. Velezis, 175 Skyline Dr., Middlebury, Conn. 06762; Alan I. Mossberg, 4375-34th St. South, St. Petersburg, Fla. 33711

[21] Appl. No.: 566,270

[22] Filed: Aug. 13, 1990

[51] Int. Cl.[5] ..... F41C 23/16

[52] U.S. Cl. ..... 42/72; 42/73

[58] Field of Search ..... 42/72, 73

[56] References Cited

U.S. PATENT DOCUMENTS 2,331,372 10/1943 Buchanan, Jr. .
2,547,180 4/1951 Taylor .
2,771,697 11/1956 Reising .
2,826,848 3/1958 Davies .
2,970,398 2/1961 Crouch .
4,502,238 3/1985 Farrar et al. .
4,601,123 7/1985 Swearengen et al. .
4,788,785 12/1988 White .
4,837,961 6/1989 Keenan .

FOREIGN PATENT DOCUMENTS 1205662 6/1986 Canada ..... 42/72

*Primary Examiner*—Richard W. Wendtland
*Attorney, Agent, or Firm*—McCormick, Paulding & Huber

[57] ABSTRACT

A forearm assembly for a pump action shotgun includes an axially elongated forearm and a pair of action bars. The forward end of each action bar is received and retained within an associated complementary recess in the rear end portion of the forearm. A piston grip comprises part of the forearm assembly and is releasably secured in fixed position to the forearm in a selected one of a plurality of angularly spaced apart mounting positions by a single fastener to accommodate either a right or left handed shooter.

16 Claims, 3 Drawing Sheets

FOREARM ASSEMBLY

BACKGROUND OF THE INVENTION

This invention relates in general to firearms and deals more particularly with improvements in forearm assemblies of the type which include a pistol grip. Such forearm assemblies, usually found on assault weapons, are presently offered as option features on many sporting firearms which are also intended to serve as home security weapons. The addition of a pistol grip to a sporting gun imparts a formidable appearance to the gun, aids in steadying it, reduces the effect of recoil and provides a substantial mechanical advantage when used to operate the action, as, for example, the pump action of a shotgun or the like.

A pistol grip is usually mounted on a firearm at a neutral or six o'clock position relative to the shooter to facilitate usage of the firearm by either a right or left handed person. However, the latter mounting position is essentially a compromise, since a right handed person would probably be more comfortable with a pistol grip located at the four o'clock position, for example, whereas a left handed person might prefer an eight o'clock mounting position, particularly where the pistol grip comprises a slide handle for operating the firearm action. Although the aforedescribed specific mounting arrangements may be generally desirable, the provision of customized handed forearms to satisfy the differing desires of right and left handed purchasers pose inventory problems for the firearm manufacturer, the distributor and the retailer.

It is the general aim of the present invention to provide an ambidextrous or universal forearm assembly which includes a forearm and a pistol grip and wherein the pistol grip may be assembled in fixed position on the forearm in a selected one of a plurality of possible mounting positions to accommodate the particular desire of an individual. It is a further aim of the present invention to provide an improved action bar assembly for a pump action firearm which includes a forearm and which reduces the number cf parts usually required to make such an assembly while maintaining or improving the operational characteristics of the firearm.

SUMMARY OF THE INVENTION

In accordance with the present invention a forearm assembly for a firearm comprises a forearm, supporting means for mounting the forearm on an associated firearm, a pistol grip, and mounting means for securing the pistol grip in fixed position on the forearm in a selected one of a plurality of angularly spaced apart mounting positions and including a plurality of angularly spaced apart threaded openings in the forearm and a single fastener passing through the pistol grip and threadably engaged in a selected one of the threaded openings. An action bar assembly includes a pair of action bars each received within an associated recess in a forearm and retained in assembly with the forearm by at least one associated fastener.

DETAILED DESCRIPTION OF PREFERRED EMBODIMENT

Figure 1:
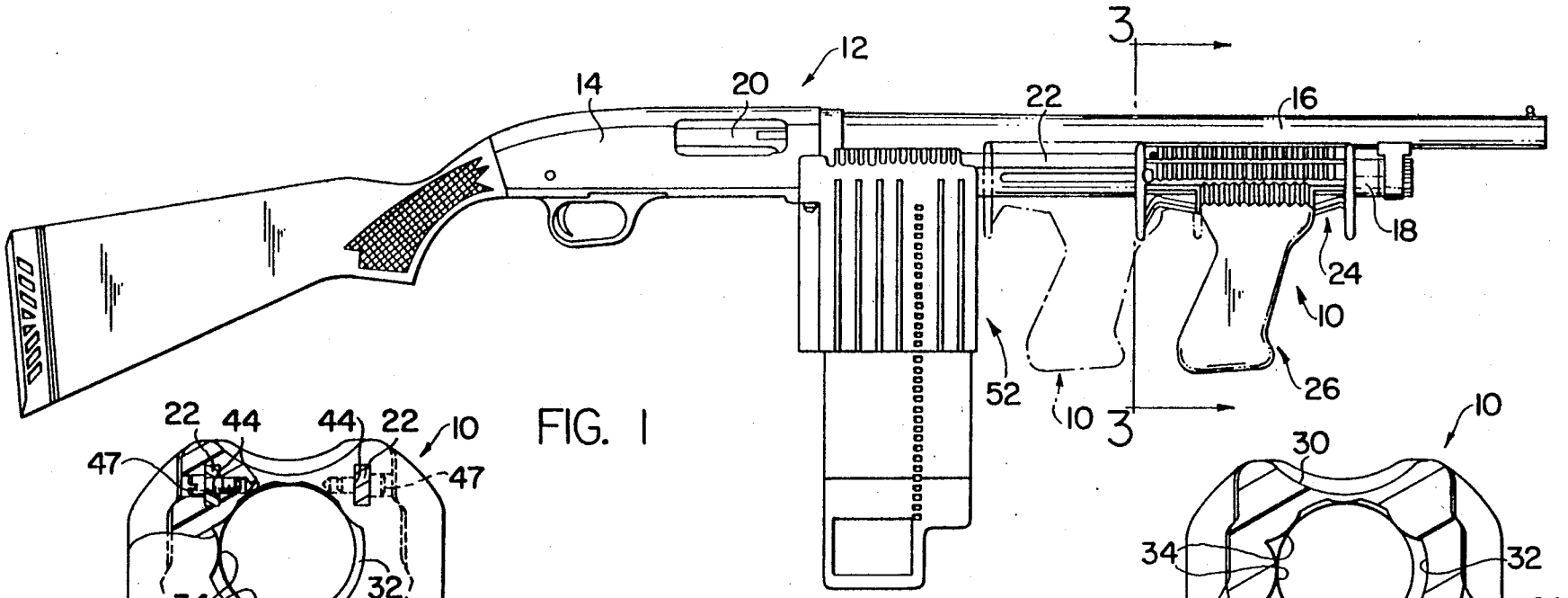
FIG. 1 is a side elevational view of a pump action shotgun having a forearm assembly embodying the present invention.

Referring now to the drawings, a forearm assembly embodying the present invention and indicated generally by the reference numeral 10 is shown in FIG. 1 mounted on a shotgun, designated generally by the numeral 12. The illustrated shotgun 12 is a pump action gun loaded from a box magazine and further illustrated and described in co-pending application Ser. No. 375,835 of George A. Velezis, filed July 5, 1989, entitled Magazine Loaded Firearm and hereby adopted by reference as part of the present disclosure.

The illustrated shotgun 12 has a receiver 14, a barrel 16 which projects forwardly from the receiver and a magazine tube 18 which also projects forwardly from the receiver below and in generally parallel alignment with the barrel. The forearm assembly 10 is slidably supported for forward and rearward reciprocal movement relative to the magazine tube 18 and connected to a breech bolt 20 within the receiver 14 by an action bar assembly which includes a pair of laterally spaced apart action bars 22,22 (one shown in FIG. 1). Full rearward movement of the forearm assembly 10 in the direction of the receiver moves the breech bolt 20 from its battery to its retired position and releases a shell (not shown) from the magazine tube 18 for movement into the receiver. An elevating mechanism (not shown) operates to raise the shell to a loading position in the path of the advancing breech bolt 20 so that the shell is chambered by the advancing breech bolt as the breech bolt moves into its battery position in response to forward or return movement of the forearm assembly 10, all of which is well known in the shotgun art.

Figure 6:
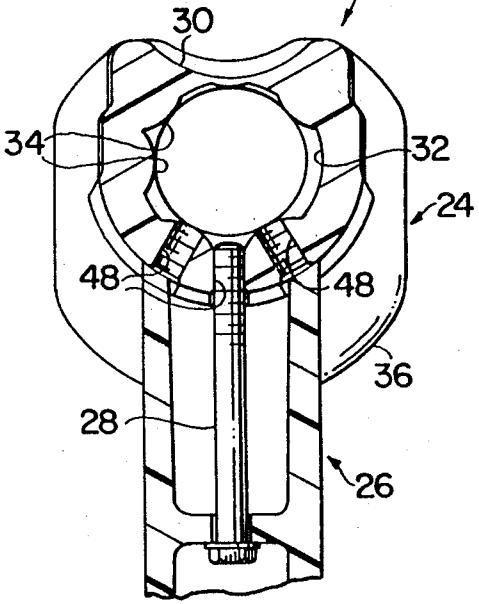
FIG. 6 is a fragmentary sectional view taken along the line 6—6 of FIG. 2.
Figure 5:
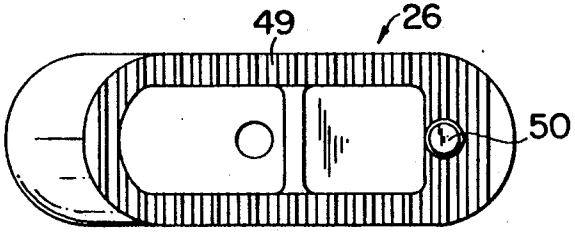
FIG. 5 is a top plan view of the pistol grip shown removed from the forearm.
Figure 2:
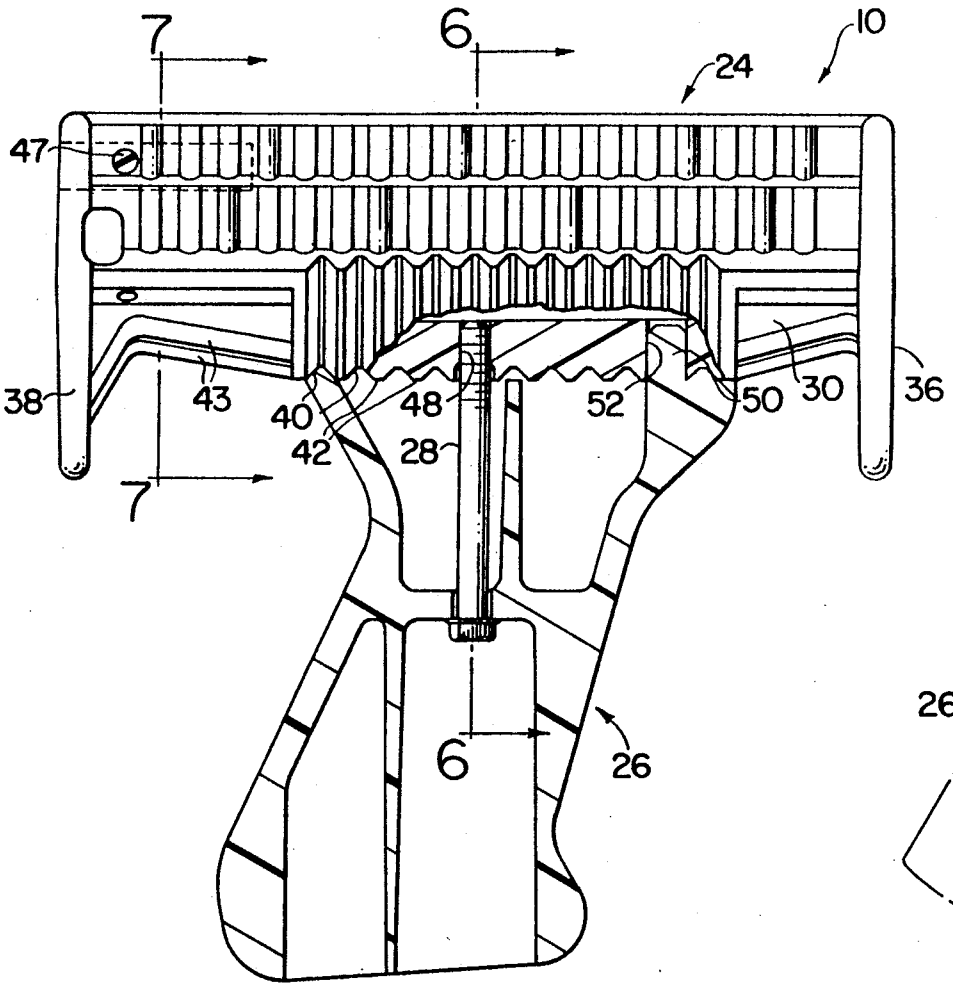
FIG. 2 is a somewhat enlarged side elevational view of the forearm assembly of FIG. 1 shown partially in vertical axial section.

Referring now particularly to FIGS. 2–6, the illustrated forearm assembly 10 comprises a forearm, indicated generally at 24, and a pistol grip designated generally by the numeral 26. The pistol grip 26 is secured in fixed position to the forearm 24 in a preselected one of a plurality of possible mounting positions by a single threaded fastener or bolt 28, as best shown in FIGS. 2 and 6.

Figure 4:
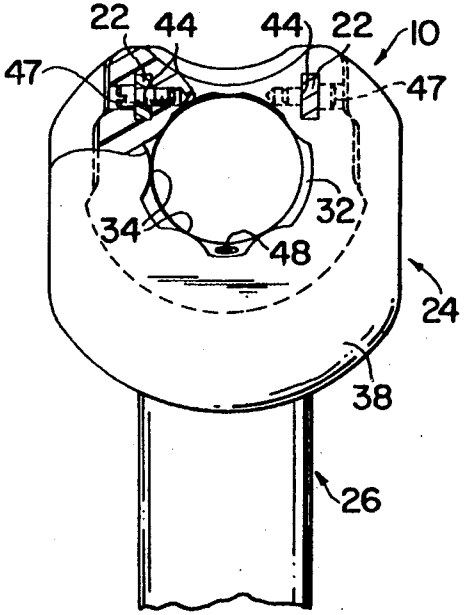
FIG. 4 is a fragmentary rear elevational view of the forearm assembly showing the means for connecting the action bars to the forearm.
Figure 3:
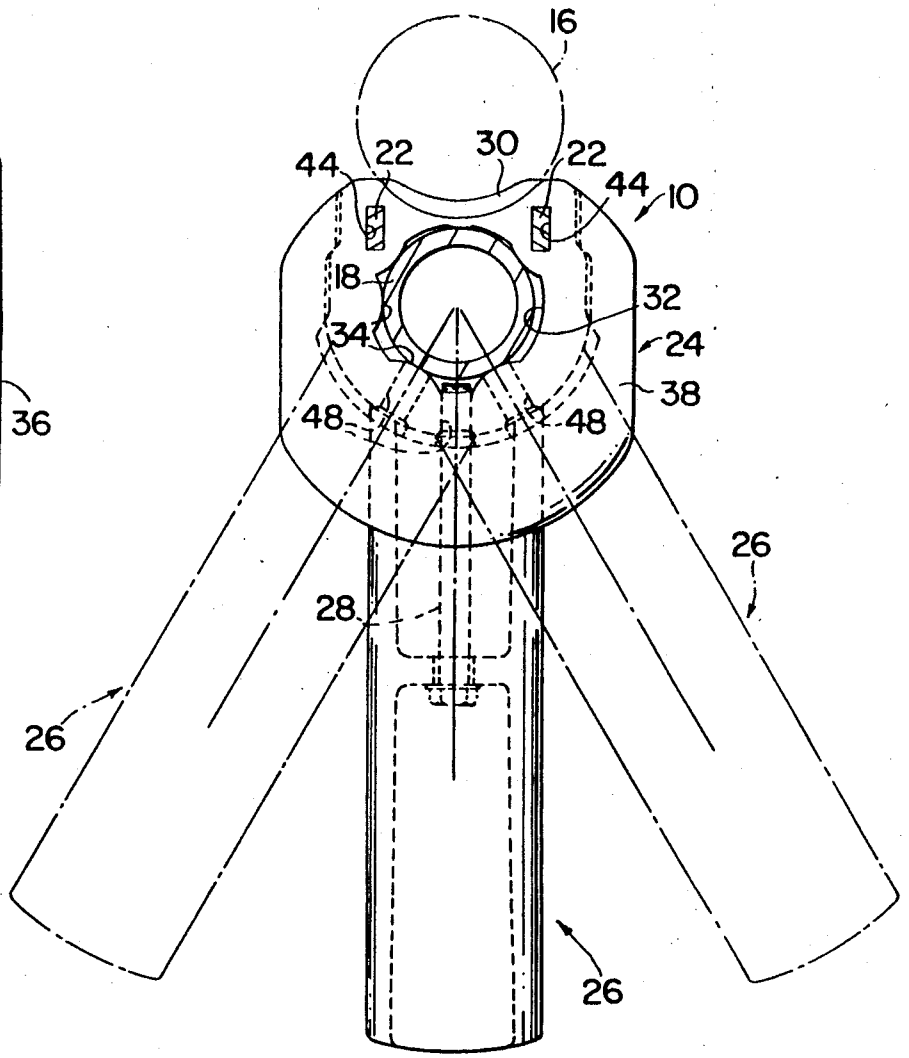
FIG. 3 is a somewhat enlarged sectional view taken along the line 3—3 of FIG. 1, alternate mounting positions of the pistol grip being indicated by broken lines.

The forearm 24 may be made from any suitable material, but preferably it is molded from relatively lightweight durable non-metallic plastic material. The presently preferred forearm 24 is made from a polycarbonate material, LEXAN 920A, and has an elongated body 30 and a bore 32 which extends longitudinally through the body for mounting the forearm on an associated firearm part, such as the illustrated magazine tube 18. Preferably, the bore 32 has a cylindrical portion of relatively short axial extent at its forward end the diameter of which is slightly larger than the outside diameter of the magazine tube 18. The remainder of the bore 32 is partially defined by a plurality of ribs 34,34 angularly spaced apart about the bore axis and which project radially into the bore 32 and extend longitudinally thereof. However, if desired, the cylindrical portion of the bore may be omitted and the ribs made to extend throughout the entire length of the bore or through only a portion of the bore length. In assembly the ribs 34,34, best shown in FIGS. 3 and 4, are disposed in direct sliding engagement with the peripheral surface of the magazine tube 18, as best shown in FIG. 3. Front and rear flanges indicated at 36 and 38, respectively, project radially outward from the front and rear ends of the forearm body 30, substantially as shown.

Figure 7:
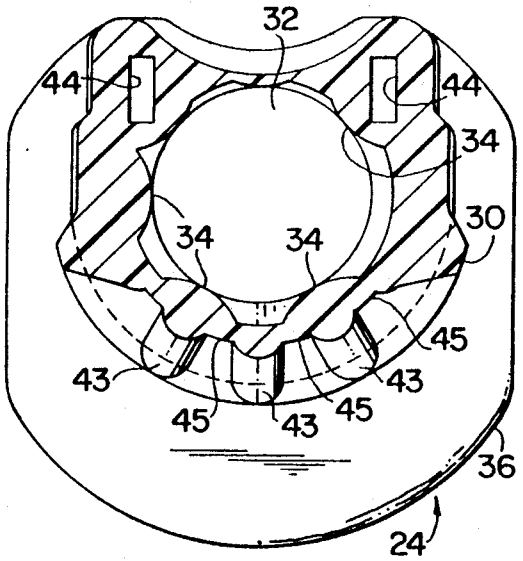
FIG. 7 is a somewhat sectional view of the forearm taken along the line 7—7 of FIG. 2.
Figure 8:
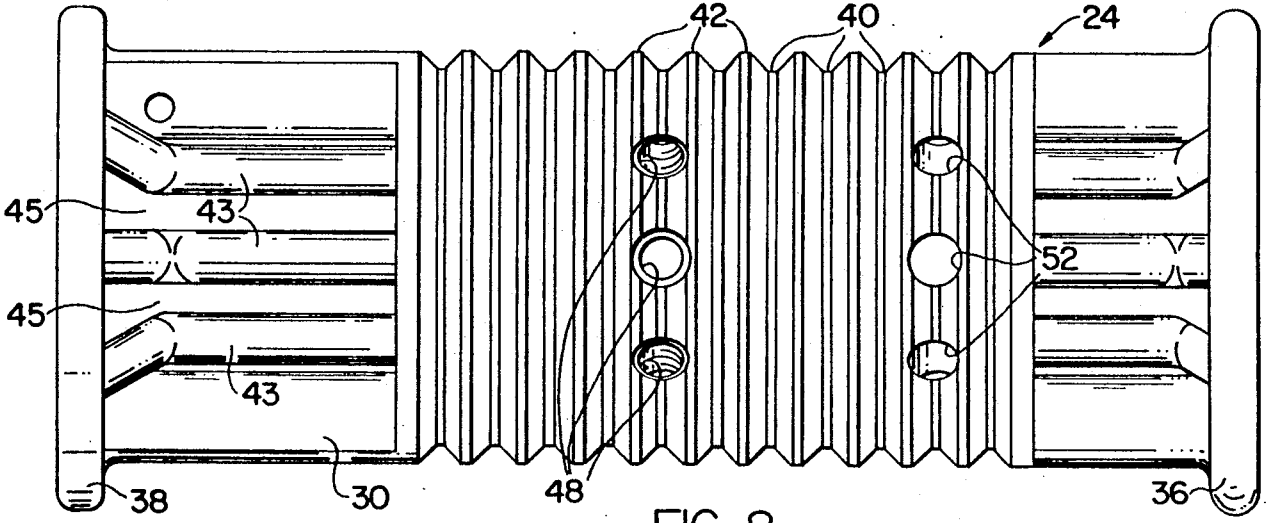
FIG. 8 is an enlarged bottom view of the forearm.

The forearm body 30 has an external gripping surface characterized by ridges and valleys and partially defined by a plurality of spaced apart grooves 40,40 and a plurality of lands 42,42, best shown in FIGS. 2 and 8. The lands are preferably of substantially equal width, each land 42 being disposed between a pair of associated grooves 40,40. In the illustrated embodiment the lands and grooves define the lower central portion of the forearm gripping surface and comprise arcuate grooves disposed in generally radial planes relative to the axis of the bore 32. The lower portion of the gripping surface is further defined by generally longitudinally extending lands and grooves indicated at 43 and 45, respectively, and best shown in FIGS. 7 and 8.

In accordance with the present invention, the two elongated longitudinally extending action bars 22,22, which comprise the action bar assembly, are attached directly to the forearm 24 in laterally spaced apart relation to each other. More specifically, the forward end portion of each action bar 22 is received and retained in an associated complementary recess 44 in the rear end portion of the forearm body 30.

At least one fastener is employed to secure the action bars to the forearm, but preferably, and as best shown in FIG. 4, a pair of fasteners 47,47 threaded into opposite sides of the body 30 forward of the rear flange 38 secure the individual action bars to the forearm. Each fastener 47 passes through an opening in an associated action bar 22 to secure it in fixed position to the forearm 24.

The pistol grip 26 may be made from any suitable material, but preferably it is also molded from a polycarbonate material such as LEXAN 920A and has a conventional pistol grip contour. The upper surface of the pistol grip 26, shown in FIG. 5, comprises a seating surface 49 characterized by ridges and valleys defined by lands and grooves sized to receive and substantially complement an associated portion of the gripping surface on the forearm 24. A generally cylindrical stud 50 integrally formed on the pistol grip projects upwardly from the seating surface 49 for a purpose which will be hereinafter evident.

Further, and in accordance with the present invention the pistol grip 26 is arranged for ambidextrous mounting in a selected one of a plurality of possible mounting positions relative to the forearm 24 and for this purpose a plurality of angularly spaced apart threaded opening 48,48 are provided in forearm body 30 to receive the fastener 28. Corresponding generally cylindrical angularly spaced apart apertures 52,52 are formed in the forearm body for receiving the stud 50. The illustrated forearm body has three such threaded openings 48,48 and three such cylindrical apertures 52,52 (FIG. 8) which provide three possible mounting positions of the pistol grip relative to the forearm body 30. However, additional threaded openings and apertures may be provided in the forearm to increase the number of possible mounting positions. Each threaded opening 48 opens outwardly through an associated portion of the gripping surface to receive the bolt 28. In like manner each aperture 52 opens outwardly through an associated portion of the gripping surface to receive the stud 50.

In accordance with the presently preferred construction one threaded opening 48 and an associated aperture 52 is located at the six o'clock position, as best shown in FIG. 3, to facilitate mounting the pistol grip 26 on the forearm 24 at a neutral or six o'clock position which enables the gun 10 to be conveniently fired by either a right or left handed person. Right and left handed mounting positions are located at four and eight o'clock as shown in FIG. 3.

The aforedescribed direct connections between the action bars 22,22 and the forearm 24 wholly eliminate the requirement for the slide tube and nut assembly usually employed to connect a forearm to an action bar assembly in a pump action firearm of the type hereinbefore described. Since the forearm is preferably made from a plastic material having a low coefficient friction relative to the magazine tube smooth sliding engagement between the ribs 34,34 and the magazine tube 18 is assured.

The universal nature of the forearm assembly 10 enables the forearm 24 to be used either with or without the pistol grip 26. The ridges and the valley in the forearm body provide a gripping surface on the forearm when the forearm is used without the pistol grip. The lands and associated grooves which define the gripping surface on the forearm 24 also cooperate with the lands and grooves in the pistol grip seating surface 49 to restrain the pistol grip against movement relative to the forearm when it is secured in selected position on the forearm by the mounting fastener 28. The stud 50 further aids in stabilizing the assembly.

The front and rear flanges 36 and 38 prevent the shooter's hand from slipping off of the forearm during opening and closing movement of the action. The rear flange 38 also protects the shooter's hand by preventing it from being pinched between the rear of the forearm and another part of the firearm such as the magazine shroud, indicated at 52 in FIG. 1, when the action is opened by operating the forearm 24 or the forearm assembly 10.

We claim:

1. Forearm assembly comprising an axially elongate forearm having a pair of spaced apart rearwardly open recesses therein, an action bar assembly having a pair of elongate action bars, each of said action bars having a forward end portion received within and substantially complementing an associated one of said recesses in said forearm, retaining means for securing said action bars to said forearm and including at least one fastening member, supporting means for mounting said forearm on a cylindrical magazine tube of an associated firearm for sliding movement along the magazine tube, a pistol grip, and mounting means for releasably securing said pistol grip to said forearm in a selected one of plurality of fixed mounting positions angularly spaced apart relative to each other about the longitudinal axis of said forearm and including a plurality of angularly spaced apart threaded openings in said forearm and a single threaded fastener passing through said pistol grip and threadably engaged in a selected one of said threaded openings.

2. Forearm assembly as set forth in claim 1 wherein said forearm has a gripping surface characterized by a plurality of ridges and valleys and said mounting means includes a seating surface on said pistol grip engaged with an associated portion of said gripping surface in said selected one position and characterized by ridges and valleys generally complementing said ridges and valleys of said gripping surface.

3. Forearm assembly as set forth in claim 2 wherein said ridges and valleys on said forearm are defined by arcuate lands and grooves radially disposed relative to the axis of said forearm.

4. Forearm assembly as set forth in claim 1 wherein said mounting means further includes a plurality of angularly spaced apart apertures in said forearm equal in number to said threaded openings and a stud integrally formed on an and projecting from said pistol grip and received in an associated one of said apertures in said selected one position.

5. Forearm assembly as set forth in claim 1 wherein said bore is partially defined by a plurality of angularly spaced apart and radially inwardly projecting ribs for sliding engagement with the magazine tube.

6. Forearm assembly as set forth in claim 5 wherein said ribs extend longitudinally of said bore.

7. Forearm assembly as set forth in claim 1 wherein said forearm has radially disposed flanges at the opposite ends thereof.

8. Forearm assembly as set forth in claim 1 wherein said retaining means includes a pair of threaded fastening members, each of said fastening members being threadably engaged with said forearm and passing through an associated one of said recesses and said end portion received therein.

9. Forearm assembly as set forth in claim 1 wherein said forearm is made from a material having a low coefficient of friction relative to the material from which the magazine tube is made.

10. Forearm assembly as set forth in claim 9 wherein said forearm is made from a polycarbonate material.

11. Ambidextrous forearm assembly comprising a forearm made from non-metallic material and including an axially elongated body having radially outwardly projecting flanges at the axially opposite ends thereof, said body having a bore extending axially therethrough and partially defined by a plurality of angularly spaced apart radially inwardly projecting ribs extending in generally parallel relation to the bore axis for mounting the forearm on the magazine tube of an associated firearm for sliding movement along the magazine tube, said body having an external gripping surface at least partially defined by a plurality outwardly open grooves and a plurality of lands, each of said lands being disposed between a pair of associated grooves, a plurality of angularly spaced apart internally threaded openings in said body opening through said gripping surface, said body having a pair of spaced apart rearwardly open recesses therein, an action bar assembly having a pair of elongate action bars, each of said action bars having a forward end portion received within and substantially complementing an associated one of said recesses in said body, retaining means for securing said action bars to said body and including at least one fastening member, a pistol grip, and mounting means for releasably securing said pistol grip in fixed position to said boy in a selected one of a plurality of angularly spaced apart mounting positions and including a seating surface on said pistol grip engaged with an associated portion of said gripping surface in said selected one mounting position and having lands and grooves complimenting the grooves and lands of said associated portion of said gripping surface and a single threaded fastener passing through said pistol grip and threadably engaged in a selected one of said openings.

12. Ambidextrous forearm assembly as set forth in claim 11 wherein said forearm has a plurality of angularly spaced apart apertures therein opening through said gripping surface and equal in number to said threaded openings and said pistol grip has an integral study projecting therefrom and received in an associated one of said apertures in said selected one position.

13. Forearm assembly comprising an axially elongate forearm, supporting means for mounting said forearm on a cylindrical magazine tube of an associated firearm for reciprocal sliding movement along the magazine tube, said forearm having a pair of spaced apart recesses opening through one end thereof, and an action bar assembly having a pair of elongated action bars, each of said action bars having an end portion received within and complementing an associated one of said recesses in said forearm, and retaining means for securing said end portion of each of said action bars in assembly with said forearm including at least one fastening member extending into and engaging said forearm.

14. Forearm assembly as set forth in claim 13 wherein said retaining means comprises a pair of threaded fastening members, each of said fastening members being threadably engaged with said forearm.

15. In a pump action firearm having a receiver, a breech bolt supported within the receiver for movement between battery and retired position, an axially elongate magazine tube projecting forwardly from the receiver, a forearm supported by the magazine tube for forward and rearward reciprocal movement relative to the receiver, and a pair of action bars connected to the forearm and to the breech bolt for moving the breech bolt between its battery and retired positions in response to movement of the forearm, the improvement comprising said forearm being made from non-metallic material and having an axially elongate bore receiving said magazine tube therethrough, portions of the wall of said bore being in direct sliding engagement with said magazine tube, said forearm having a pair of spaced apart recesses opening through the rear end thereof, each of said action bars having an end portion received within and substantially complementing an associated one of said recesses, and retaining means for securing said action bars in assembly with said forearm and including at least one fastening member engaged with said forearm.

16. In a pump action firearm as set forth in claim 15 the further improvement wherein said bore is partially defined by a plurality of angularly spaced apart and radially inwardly projecting ribs extending in parallel relation to the bore axis and supporting said forearm on said magazine tube for sliding movement therealong with said ribs in substantial engagement with said magazine tube.

* * * * *